US005937806A

United States Patent [19]

Lyko et al.

[11] Patent Number: 5,937,806

[45] Date of Patent: Aug. 17, 1999

[54] CLOSED-LOOP CAMSHAFT PHASER CONTROL

[75] Inventors: Bohdan Michael Lyko, Webster; Thomas Howard Lichti, Fairport; Daniel Richard Cuatt, Henrietta; John S. Lylak, Jr.; Ivan Rafael Samalot, both of Rochester, all of N.Y.

[73] Assignee: General Motors Corporation, Detroit, Mich.

[21] Appl. No.: 09/041,650

[22] Filed: Mar. 13, 1998

[51] Int. Cl.[6] ..... F01L 1/34

[52] U.S. Cl. ..... 123/90.15; 123/90.17

[58] Field of Search ..... 123/90.15, 90.17, 123/90.31

[56] References Cited

U.S. PATENT DOCUMENTS

| | | | |
|---|---|---|---|
| 5,333,577 | 8/1994 | Shinojima | 123/90.15 |
| 5,363,817 | 11/1994 | Ikeda et al. | 123/90.15 |
| 5,417,187 | 5/1995 | Meyer et al. | 123/90.15 |
| 5,522,352 | 6/1996 | Adachi et al. | 123/90.15 |
| 5,570,621 | 11/1996 | Kabasin | 91/363 |
| 5,623,896 | 4/1997 | Kato et al. | 123/90.15 |

*Primary Examiner*—Weilun Lo

*Attorney, Agent, or Firm*—Michael J. Bridges; Vincent A. Cichosz

[57] ABSTRACT

Internal combustion engine variable valve timing control with a camshaft phaser for varying rotational phase between a camshaft and a crankshaft in response to a control command determined through a hybrid control strategy without resort to direct temperature measurement. For a range of phase errors requiring high response compensation, a control strategy emphasizing rapid response, such as a bang-bang strategy, is deployed. For a range of phase errors requiring high accuracy compensation, a control strategy emphasizing high precision, such as a proportional-plus-integral strategy, is deployed. The phase error ranges are updated periodically to account for changes in operating conditions. The control command includes an offset which varies in response to a periodically estimated control deadband to affirmatively account for the deadband with each issued control command.

9 Claims, 4 Drawing Sheets

CLOSED-LOOP CAMSHAFT PHASER CONTROL

TECHNICAL FIELD

This invention relates to internal combustion engine control and, more particularly, to closed-loop control of a hydraulic actuator of a continuously variable camshaft phaser.

BACKGROUND OF THE INVENTION

Automotive hydraulic control systems, such as applied for the control of a continuously variable camshaft phaser, have been proposed in which the pressure of a control fluid, such as oil, is controlled for positioning of a hydraulic actuator. Control fluid viscosity can vary significantly with fluid temperature. Accordingly, it has been proposed to directly measure control fluid temperature using a conventional thermocouple or thermistor, and to control the actuator in response to measured temperature. More specifically, it has been proposed to determine an initial control command as a function of measured control fluid temperature, and to vary control gains in response to measured variation in control fluid temperature. The transducer for measuring control fluid temperature, such as a conventional thermocouple or thermistor can add significant cost to the hydraulic control system and may not accurately reflect the relevant fluid temperature characteristic. It would therefore be desirable to provide for control of the hydraulic actuator control in response to an accurate indication of oil temperature without use of a temperature transducer, so that the transducer may be removed from the system and control accuracy improved.

The hydraulic actuator may be applied in continuously variable camshaft phaser control for varying phasing between an internal combustion engine camshaft and an internal combustion engine crankshaft. The variation in phasing is known to provide engine emissions benefits, for example through precise control of an amount of dilution of an engine cylinder inlet air-fuel charge without use of external exhaust gas recirculation systems, in an internal dilution control process. It has been established that responsive, precision phasing between the camshaft and crankshaft must be maintained under substantially all engine operating conditions to yield the emissions benefits associated with such phasing control. Accordingly, it would be desirable to precisely and responsively control the hydraulic actuator that drives the phaser position under all operating conditions without resort to direct measurement of hydraulic control fluid temperature.

SUMMARY OF THE INVENTION

The present invention provides for precise, responsive control of a hydraulic actuator applied in a continuous camshaft phasing control application without use of a temperature transducer, allowing for elimination of such transducer to reduce system cost and complexity.

More specifically, a closed-loop hybrid control of hydraulic actuator position responsive to camshaft and crankshaft position feedback signals provides for precise, responsive control of camshaft phase relative to the crankshaft. The feedback signals and a desired cam angle position are applied to generate an error signal. For relatively large error signals in which response to the error may dominate over precision, a highly responsive control technique, such as a bang-bang control technique, is applied to rapidly drive the error toward zero. For relatively small errors in which control precision may dominate over control response, a precise control technique that accounts for stringent transient response requirements, such as a proportional-plus-integral control technique, is applied to responsively drive the error toward zero with minimum overshoot and settling time.

In accord with a further aspect of this invention, the control freely transitions between the highly responsive control technique and the precise control technique in response to the magnitude of the position error. In accord with yet a further aspect of this invention, the manner of transitioning between the highly responsive control technique and the precise control technique is adapted on-line to account for changes in control system operating conditions.

In accord with a further aspect of this invention, an initial control drive signal applied to the actuator that is coupled to the phaser is determined without resort to direct actuator control fluid temperature measurement through an on-line calibration procedure in which the drive signal is gradually increased from a base signal while the actuator position is monitored. The minimum drive signal associated with motion of the actuator is used to determine a starting drive signal on which all subsequent drive signals are based, at least until the starting drive signal is updated through a further iteration of such on-line calibration procedure. In accord with yet a further aspect of this invention, control gains are periodically updated on-line in response to changes in operating conditions.

BRIEF DESCRIPTION OF THE DRAWINGS

The invention may be best understood in reference to the preferred embodiment and to the drawings in which.

DESCRIPTION OF THE PREFERRED EMBODIMENT

Figure 1:
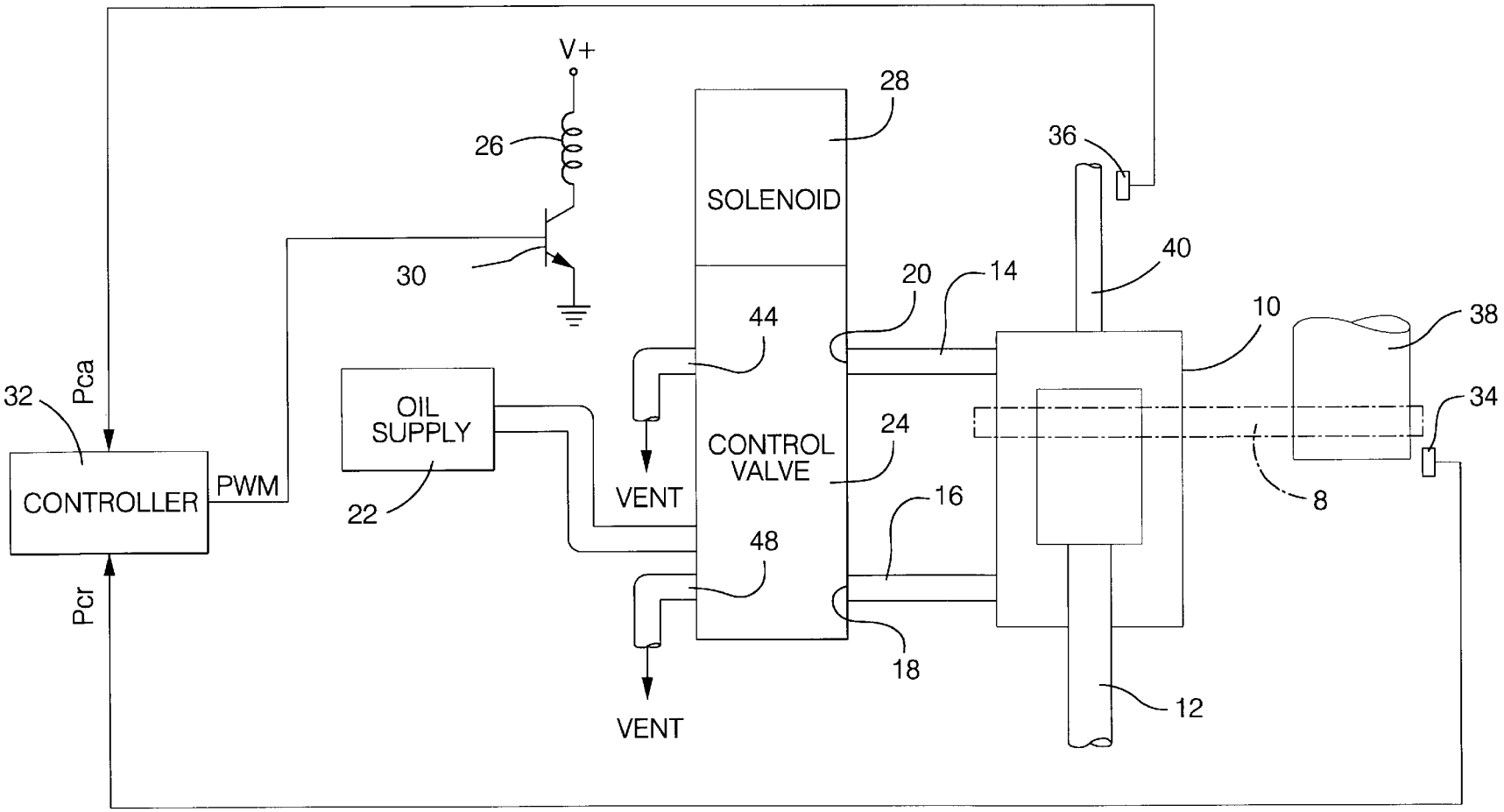
FIG. 1 is a general illustration of the continuously variable engine camshaft phaser control system hardware of the preferred embodiment.

Referring to FIG. 1, a hydraulic control system is provided to control the position of a hydraulic actuator 12 such as a piston, to provide for linear positioning thereof along a range of motion. The piston 12 may move in this embodiment bi-directionally, wherein hydraulic fluid pressure is applied to a first side of the piston 12 from hydraulic fluid admitted through passage 14 to a first side of the piston, and may move in a reverse direction of motion from pressure applied by hydraulic fluid passing through a second passage 16. The piston may move, as influenced by hydraulic pressure applied thereto, along a sleeve (not shown) attached to a phasing device 10, wherein the phasing device may be of conventional design for varying the angular relationship between a crankshaft 38 and camshaft 40 as is generally understood in the art. For example, the piston 12 may be attached, such as via a conventional paired block configuration or a conventional helical spline configuration, to a toothed wheel (not shown), on which is disposed a chain 8 linked to the crankshaft 38. The phaser 10 may then be fixedly mechanically linked to the camshaft 40.

A control valve 24, of a conventional four-way, electronic solenoid-controlled type, meters a control fluid, such as common engine oil, from an oil supply 22 including a conventional oil pump for maintaining a regulated oil pressure, through first and second control ports 18 and 20 and through respective fluid passages 16 and 14 to first and second sides of piston 12. The relative hydraulic pressure thereby applied to the first and second sides of the piston 12 determines the steady state position of the piston 12 and thereby the steady state phase difference between the camshaft 40 and the crankshaft 38 as is generally understood in the phaser control art. Precise positioning of the piston 12 along a sleeve (not shown) of the phaser 10 is provided through precise electronic control of the control valve 24 via control signal PWM. In a rest position of the control valve 24, the control fluid is vented away from the piston 12 via vents 44 and 48 so as to not influence piston position. As the solenoid is electronically driven away from the rest position, a portion of the control fluid is applied through the control ports 18 and 20 to the piston 12 to apply hydraulic force to first and second sides of the piston 12 to drive the piston bi-directionally away from the rest position.

The control valve 24 may be a conventional four-way valve having a linear, magnetic field-driven solenoid, positioned in accord with the level of current passing through corresponding coil 26. The force applied to the piston 12 may generally be expressed as hydraulic pressure multiplied by piston area. In the embodiment of this invention in which piston 12 is linearly actuated in accord with the relative pressure thereacross, the piston 12 will be displaced in a first direction when control port 18 is supplying a more significant fluid pressure through passage 16 than is control port 20 through its passage 14, and will be displaced in a second direction when control port 20 is supplying the more significant fluid pressure. In the present embodiment in which the piston is positioned along a substantial continuum of positions, so as to vary the angular relationship between crankshaft 38 and camshaft 40 in accord with generally understood automotive phasing techniques, variable valve timing is provided by varying the linear displacement of piston 12 within phaser 10. Examples of such phasing hardware may be generally found in U.S. Pat. Nos. 5,119,691, 5,033,327, and 5,163,872, assigned to the assignee of this application.

Pulse width modulation PWM control is provided for current control through the coil 26, wherein a fixed frequency, fixed amplitude, variable duty cycle signal is passed to switch 30. Switch 30 may be a common transistor and the PWM signal applied to the base thereof, wherein the transistors conduct from collector to emitter when the PWM signal applied to the base thereof is high, and do not conduct otherwise.

Switch 30 is connected between a low side of coil 26 and a ground reference. The high side of coil 26, opposing the low side of the coil, is electrically connected to a supply voltage V+, of approximately twelve volts in this embodiment. Accordingly, when switch 30 is conducting, current will be increasing exponentially in the coil 26 toward an average current that is a predetermined function of the voltage across the coil and coil resistance. Alternatively, when such switch is not conducting, such as during the off-portion of each PWM cycle, current will be exponentially decaying in the coil 26 toward zero. The valve 24 will be held, for a given duty cycle, substantially at a fixed position corresponding to the average current in the coil 26, as is generally understood in the solenoid control art. The frequency of the PWM signal should be set high enough that piston 12 position is stable for a fixed PWM value, wherein, for a fixed PWM value, the changing current through coil 26 does not lead to any significant variation in piston position. Calibration of the hydraulic control system, wherein the electrical damping provided through coil 26 and hydraulic fluid damping may be accounted for, may yield information on a sufficiently high PWM frequency that may be used to provide for such stability.

Conventional camshaft position sensor 34 and conventional crankshaft position sensor 36 are disposed in proximity to the camshaft and crankshaft, respectively to transduce rotational phase thereof into respective output signals Pca and Pcr. The signals are applied to suitable conventional input ports of controller 32 for conversion and application as control feedback signals, a combination of which indicate relative phase between the camshaft 38 and crankshaft 40. Controller 32 may be a simple single chip micro-controller having such conventional controller elements as a central processing unit, non-volatile and volatile memory devices, input/output devices, and other elements generally known in the art to be used for vehicle control operations.

Generally, the controller 32, through periodic execution of a sequence of control operations, provides for responsive, precise control of the phasing between the crankshaft 38 and camshaft 40 to provide for generally recognized emissions reduction benefits. Such benefits are made substantially insensitive to change in hydraulic fluid temperature without the cost or complexity associated with direct temperature measurement through a hybrid control approach, with bang-bang control for substantial control error, PID control for relatively small position error, and through use of on-line calibration procedures to estimate initialization points for the control.

Figure 2:
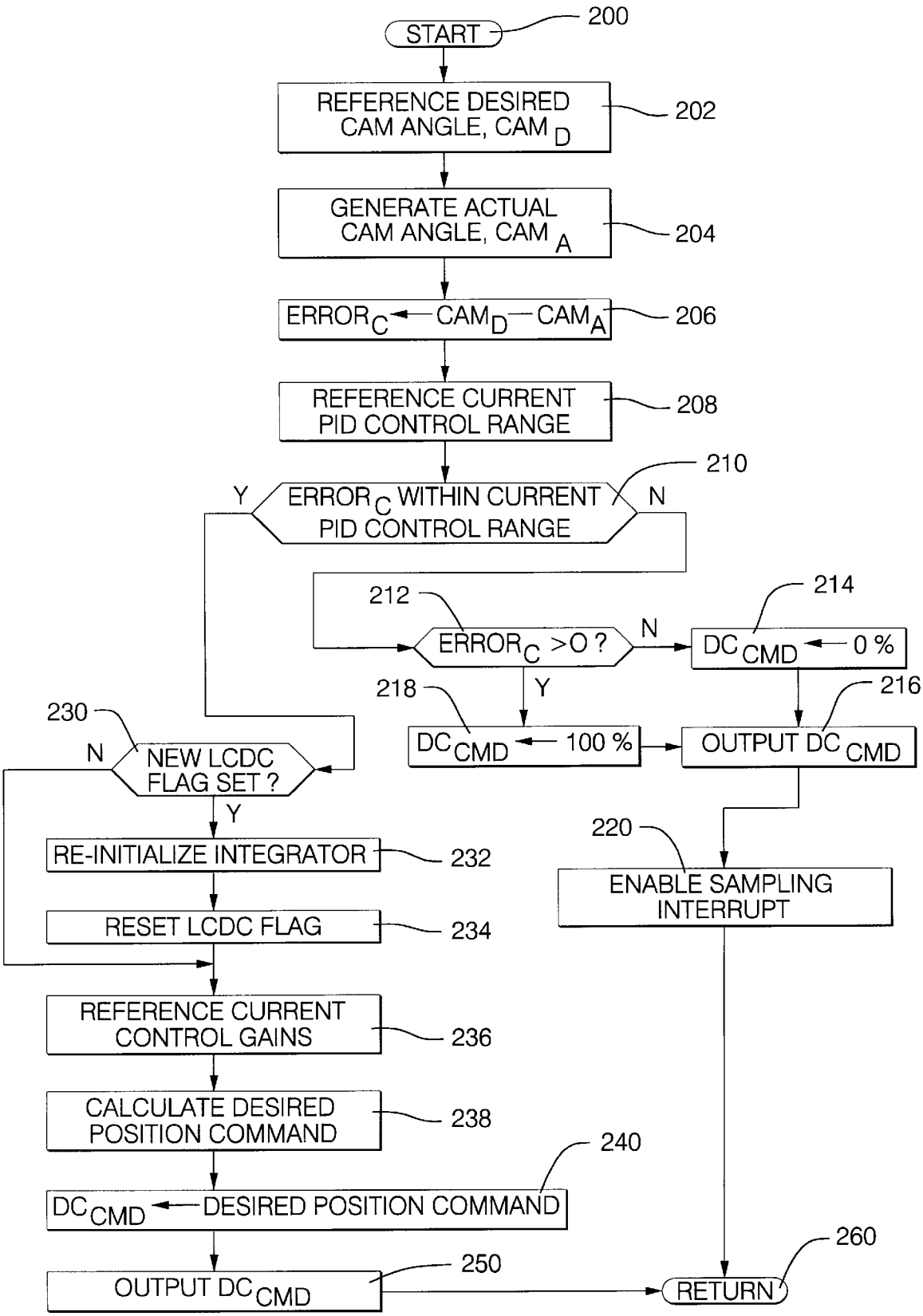
FIGS. 2–4 are block diagrams illustrating a flow of operations for controlling the hardware of FIG. 1 in accord with the preferred embodiment of this invention.
Figure 3:
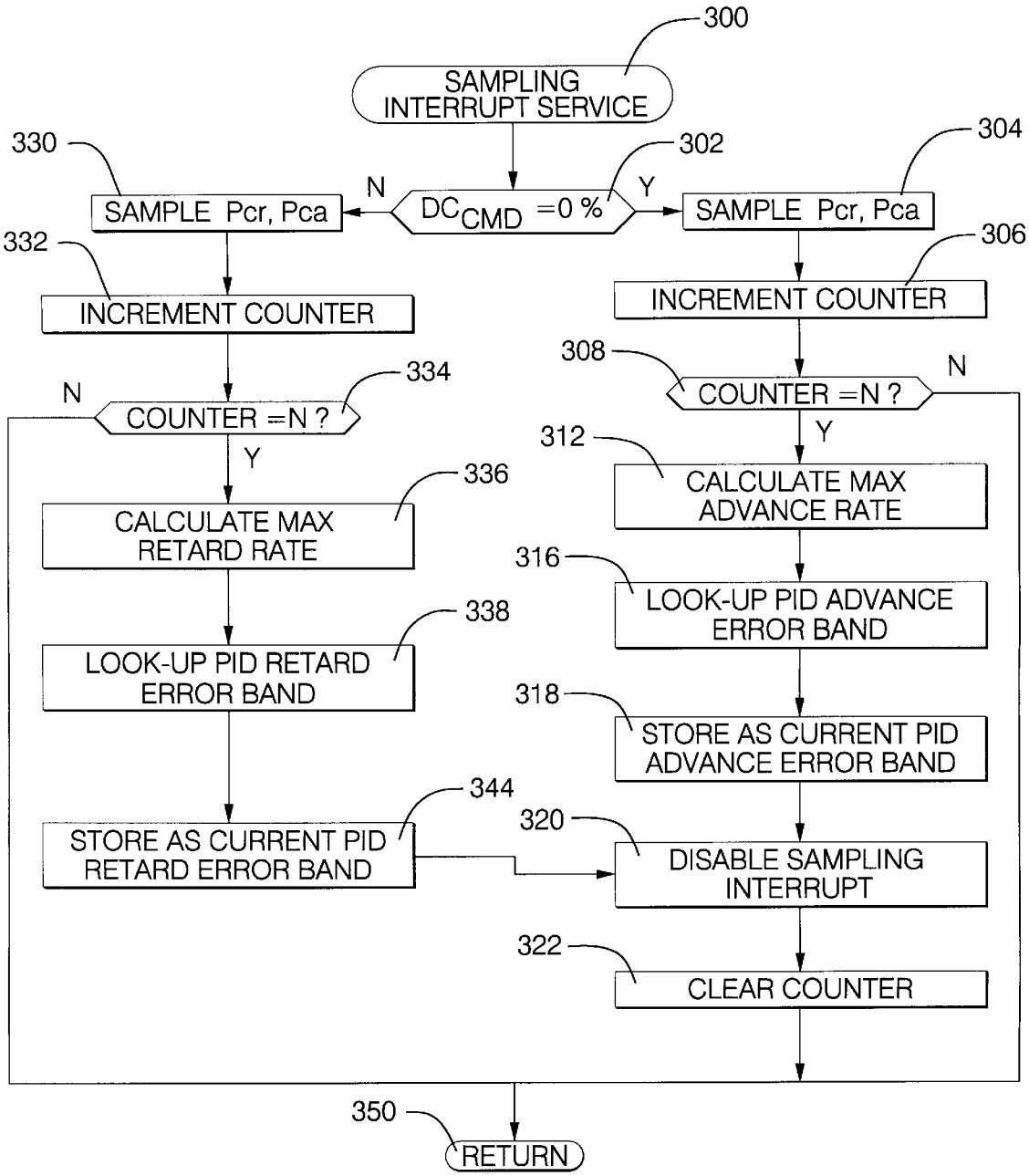
Figure 4:
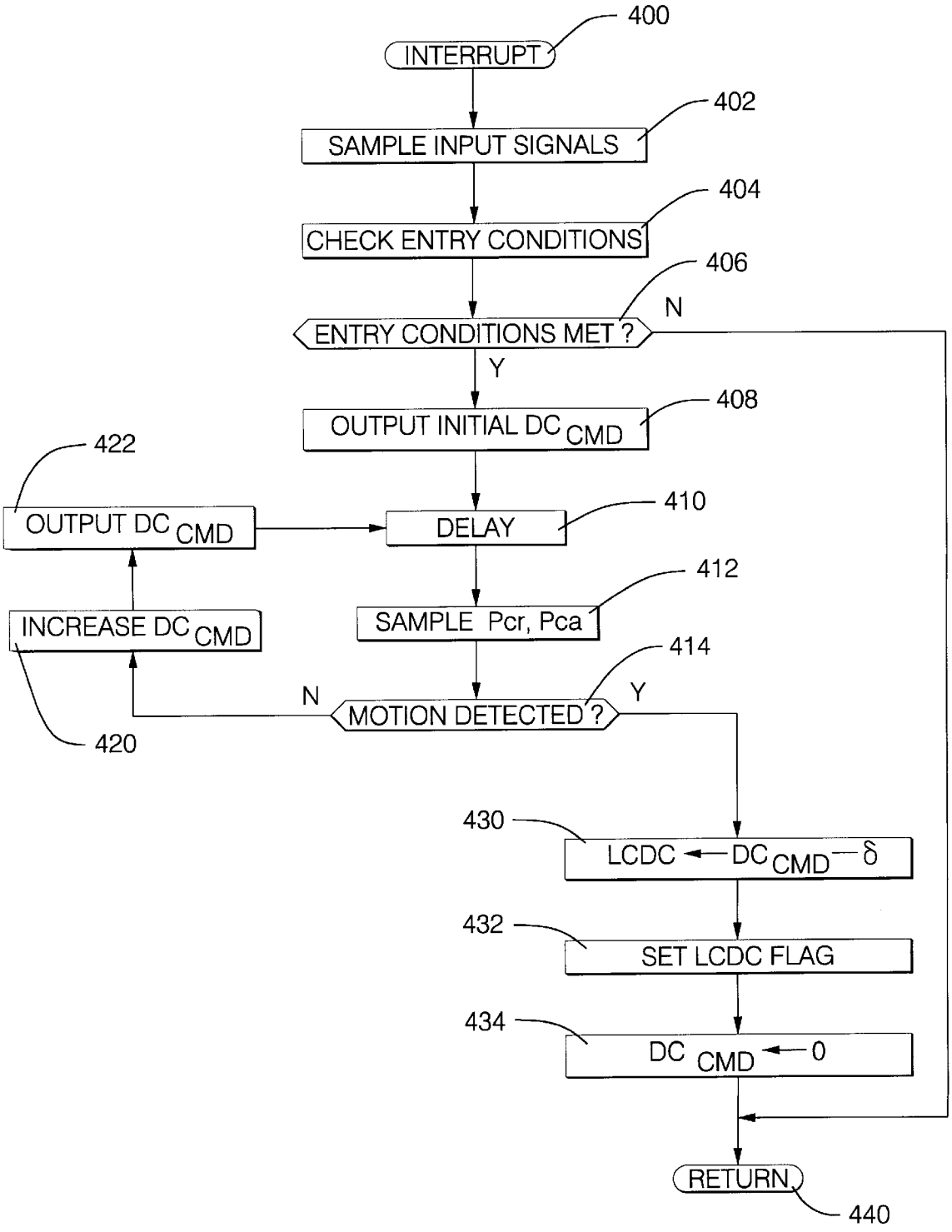

Such control operations are provided for through the series of operations illustrated, in a step-by-step manner, in FIGS. 2–4. Specifically, the operations of FIG. 2 are carried out periodically while the controller 32 of FIG. 1 is active, such as while ignition power is applied to the controller 32 from an operator of the system of FIG. 1. The operations of FIG. 2 establish and output a duty cycle command PWM for driving the control valve 24 in the described manner for precise, responsive position control of piston 10. These operations begin at a step 200 upon occurrence of a periodic time-based interrupt of controller 32 of FIG. 1, such as about every 12.5 milliseconds while the controller 32 is active, and proceed next to reference a desired cam angle $CAM_D$, at a step 202. $CAM_D$ is established and updated periodically while the controller 32 is active as the desired phase offset between the operating angle of the camshaft 40 and that of the crankshaft 38 to provide a desired degree of internal cylinder charge dilution for generally recognized emissions reduction benefits, as is generally understood in the art. $CAM_D$ may be determined as a function of current system operating conditions, through control operations carried out in a time-based routine of any suitable conventional type.

Following the step 202, actual cam angle $CAM_A$ is generated at a next step 204 as a direct function of the displacement of piston 12 of FIG. 1 away from a start position. The displacement of the piston 12 corresponds to the relative phase between the crankshaft 38 and camshaft 40 as indicated by signals Pcr and Pca from respective sensors 34 and 36 (FIG. 1). The difference between $CAM_D$ and $CAM_A$, termed $ERROR_C$, is next determined at a step 206 as CAM angle error. The CAM angle error is precisely and responsively driven toward zero in accord with the preferred embodiment of this invention. A current PID control range is next referenced at a step 208 from controller 32 (FIG. 1) memory, as the range of relatively small CAM angle errors that can effectively be managed with PID control techniques. The PID control range is dynamic in this embodiment in that it may change in magnitude with change in system conditions, as will be further described for the operations of FIG. 3. The current CAM angle error $ERROR_C$ is next compared to the current PID control range at a step 210. If $ERROR_C$ is within the current PID control range, a suitable control strategy for controllably driving the error toward zero with acceptable transient response is applied to the hydraulic control system of FIG. 1, such as a conventional control strategy that provides for minimum overshoot, minimum rise and settling time and minimum oscillation. In this embodiment, the control strategy is a proportional-plus-derivative-plus-integral (PID) control strategy. The control strategy is applied by carrying out the steps 230–250.

More specifically, the state of a stored status flag indicating the state of a learned control duty cycle and termed the NEW LCDC flag, is analyzed at a step 230. The LCDC flag is set through the operations of FIG. 4, to be described. If the NEW LCDC flag is determined to be set at the step 230, a new duty cycle is available for the control, requiring a reset of the integrator on which the control command is founded. Accordingly, an integrator is reset at a next step 232 as a function of a new learned control duty cycle LCDC, established through the operations of FIG. 4, as follows:

$$INT=LCDC-X$$

in which X is an application-specific constant percent duty cycle offset, determined through a conventional calibration procedure. After re-initializing the integrator at the step 232, the NEW LCDC flag is reset at a next step 234. Next, or if the NEW LCDC flag was determined to not be set at the step 230, a set of current control gains are referenced at a next step 236, including proportional gain Kp, and integral gain Ki. Such gains may, in accord with an aspect of this invention, be dynamic, in that they may vary in magnitude away from an initial calibrated value as a function of variation in LCDC magnitude. The manner in which they vary as a function of LCDC may be determined through a conventional calibration procedure in which, for a given LCDC value, appropriate gains providing for a desired control function performance may be set for a representative control system consistent with that of FIG. 1, as is generally understood in the art. The following TABLE 1 illustrates representative gains determined through such a calibration procedure for application when the camshaft phase is to be retarded. The gains vary with engine speed (rpm) which is proportional to the rate of rotation of the crankshaft 38 of FIG. 1, and is indicated by signal Pcr, as is generally understood in the art. In TABLE 1, Kp is expressed as duty cycle divided by position error, and Ki is expressed as duty cycle divided by error, as a function of time.

TABLE 1

| | Kp | | | | Ki |
|---|---|---|---|---|---|
| LCDC | 800 rpm | 1600 rpm | 2400 rpm | 6300 rpm | ALL SPEEDS |
| 52 | .56 | .56 | .5 | .88 | 1.2 |
| 58 | .75 | .75 | .81 | .94 | 1.0 |
| 64 | 1.3 | .82 | .75 | .88 | 0.8 |
| 70 | 2.3 | .88 | .81 | 1.1 | 0.6 |

Likewise, the following TABLE 2 illustrates representative gains determined through such a calibration procedure for application when the camshaft phase is to be advanced. The gains vary with engine speed (rpm) which is proportional to the rate of rotation of the crankshaft 38 of FIG. 1, and is indicated by signal Pcr, as is generally understood in the art. In TABLE 2, Kp is expressed as duty cycle divided by position error, and Ki is expressed as duty cycle divided by error, as a function of time.

TABLE 2

| | Kp | | | | Ki |
|---|---|---|---|---|---|
| LCDC | 800 rpm | 1600 rpm | 2400 rpm | 6300 rpm | ALL SPEEDS |
| 52 | .5 | .56 | .6 | .63 | 1.2 |
| 58 | 2.7 | .2 | 1.9 | 1.6 | 1.0 |
| 64 | 4.3 | 4.1 | 4.1 | 3.6 | 0.8 |
| 70 | 6.3 | 6 | 5.8 | 5.6 | 0.6 |

The control gains, whether static gains established through a conventional calibration procedure, or whether dynamic gains, varying in the described manner, are stored in the form of a standard lookup table in a standard memory device of controller 32 of FIG. 1. Standard interpolation operations are applied to reference gain values between the entries appearing in any such table. Returning to FIG. 2, after referencing the current control gains at the step 236, a desired piston position command CMD for driving the piston from its current position toward a piston position corresponding to minimum cam angle error, is next determined at a step 238 as follows:

$$CMD=LCDC+Kp*ERROR_C+Ki*\int(ERROR_C)dt$$

in accord with generally understood classical position control techniques in which LCDC is a learned duty cycle offset for overcoming a control deadband associated with the hydraulic actuator 12 of the control system of FIG. 1, as described.

The position command CMD is next applied in a determination of the duty cycle command signal $DC_{CMD}$ that is to be applied to switch 30 of FIG. 1 to provide for the desired piston position determined at the step 238. The duty cycle command signal may be determined in any suitable conventional manner, such as by identifying the current waveform of coil 26 of FIG. 1 needs to maintain control valve 24 spool position in a state providing for the desired position determined at the step 238, and by identifying the PWM signal needed to provide for such current waveform. The determined duty cycle command is next output at a step 250 in the form of signal PWM of FIG. 1 to switch 30 in the manner described.

Returning to step 210 of FIG. 2, if $ERROR_C$ is determined to be so substantial in magnitude that is does not lie within the current PID control range, then a control strategy providing for rapid response to the error condition, such as a bang-bang control strategy is applied to the hydraulic control system of FIG. 1, by carrying out steps 212–220 of FIG. 2. Specifically, if $ERROR_C$ is greater than zero, as determined at a next step 212, then the camshaft angle must be retarded relative to the crankshaft angle, and a maximum duty cycle, such as one hundred percent duty cycle is assigned to the command $DC_{CMD}$ at a next step 218 to provide for responsive retard of the camshaft angle. However, if $ERROR_C$, which has already been determined to be of sufficient magnitude so as to exceed the PID control range at the step 210, is not greater than zero at the step 212, then the camshaft angle must be advanced relative to the crankshaft angle, and a minimum duty cycle, such as zero percent duty cycle, or some small duty cycle slightly greater than zero, is assigned to the command $DC_{CMD}$ at a next step 214 to provide for responsive advance of the camshaft angle.

Following the step 214 or the step 218, the adjusted duty cycle command $DC_{CMD}$ is output in the form of a pulse width modulated command PWM to switch 30 of FIG. 1 at a next step 216 for driving control valve 24 as described.

Following the step 216, a sampling interrupt is enabled at a next step 220. The sampling interrupt provides for on-line measurement of piston 12 (FIG. 1) responsiveness. The measurement is then applied to adapt the hybrid control strategy detailed in FIG. 2. For example, if it is determined through the operations of FIG. 3 that the piston is "sluggish" or relatively slow in response, for example due to low temperature (high control fluid viscosity) operating conditions, then the hybrid control provided through the operations of FIG. 2 will be adapted for increased operation in the high response mode of steps 212–220 of FIG. 2, as there is reduced potential for undesirable transient response instability. However, if it is determined through the operations of FIG. 3 that the piston is relatively fast in its response, for example due to high temperature (low hydraulic fluid viscosity) operating conditions, then the hybrid control provided through the operations of FIG. 2 will be adapted for increased operation in the controlled response mode of steps 230–250 of FIG. 2, to reduce the potential for unsatisfactory transient response and as adequate response can still be achieved in such mode. Returning to FIG. 2, after enabling the sampling interrupt at the step 220, and following the step 250, the operations of FIG. 2 are concluded by returning, via a next step 260, to resume execution of any controller operations that were temporarily suspended to allow for servicing of the interrupt that invoked the operations of FIG. 2.

Referring to FIG. 3, the sampling interrupt service operations are described in a step by step manner for execution following each of periodic sampling interrupts, such as may occur approximately every six milliseconds while the interrupt is enabled through step 220 of FIG. 2. Upon occurrence of the sampling interrupt, any ongoing controller operations of a lower priority than the service operations of FIG. 3 are temporarily suspended, and the operations of FIG. 3 are initiated at a step 300 and proceed to a next step 302 at which the current duty cycle command $DC_{CMD}$ as established through the most recent iteration of the operations of FIG. 2, is compared to a minimum duty cycle, such as zero percent duty cycle, as is assigned to $DC_{CMD}$ at the described step 214 of FIG. 2. If $DC_{CMD}$ is currently set to the minimum command, then the piston 12 of FIG. 1 is currently being advanced at a maximum rate, and the steps 304–318 are executed to measure the actual rate of advance of the piston 12, and otherwise the piston 12 is currently being retarded at a maximum rate, and the steps 330–344 are executed to measure the actual rate of retard.

More specifically, if the duty cycle command is determined to be at the minimum command at the step 302, actual position signals Pcr and Pca are sampled at a next step 304, and the phase difference between the crankshaft 38 and the camshaft 40 (FIG. 1) that is indicated by such signals is determined and stored in a standard random access memory device of controller 32 (FIG. 1) at a next step 304. A counter, stored in a standard random access memory device of controller 32 of FIG. 1, is next incremented at a step 306. If the counter equals a count limit N, which is set to about ten in this embodiment, as determined at a next step 308, then a sufficient number of samples of Pcr and Pca have been taken to allow for an accurate assessment of piston responsiveness under the maximum advance operating conditions. Accordingly, steps 312–318 are carried out to determine and compensate for the measured responsiveness of the piston 12 of FIG. 1.

Specifically, a maximum advance rate is calculated at a step 312 as an average time rate of change in phase between samples of signals Pcr and Pca. For example, if ten signal samples are taken through ten iterations of the operations of FIG. 3, the change in phase provided by the change in position of the piston 12 (FIG. 1) between each of such readings may be averaged and the average divided by the rate the readings were taken to arrive at an average time rate of change in phase, indicating the maximum advance rate of the piston 12. The maximum advance rate is next applied to reference a corresponding PID advance error band at a next step 316. A schedule of advance error bands as a function of maximum advance rates is generated in this embodiment through a conventional calibration procedure. For example, a preferred piston position trajectory from an initial position to a final position may be designed through the application of ordinary skill in the art. The position trajectory includes, near the final position, a controlled piston deceleration to minimize overshoot and oscillation with minimum compromise to overall response time. For each maximum advance rate along a range of maximum advance rates, the controlled deceleration must begin at varying times along the piston position trajectory. The time that such deceleration begins is established for each maximum advance rate, and is stored in the schedule as the PID error band with the corresponding maximum advance rate. The schedule is stored in a conventional non-volatile memory device of controller 23 of FIG. 1, such as a standard read only memory device. A current PID error band is then referenced from the stored schedule as the PID error band corresponding to the maximum advance rate calculated at step 312. The referenced PID error band is then stored as the current PID advance error band at a next step 320, for use in subsequent iterations of the operations of FIG. 2.

Returning to step 302, if it is determined that the duty cycle command is not set to a minimum value, then operations to determine a PID retard error band are carried out beginning with a step 330, at which actual position signals Pcr and Pca are sampled and the phase difference between the crankshaft 38 and camshaft 40 of FIG. 1 is determined therefrom and is stored in a standard random access memory device of controller 32 (FIG. 1) as an indication of the current position of the piston 12 (FIG. 1). A counter, stored in a standard random access memory device of controller 32 of FIG. 1, is next incremented at a step 322. If the counter equals a count limit N, which is set to about ten in this embodiment, as determined at a next step 334, then a sufficient number of position signal samples have been taken to allow for an accurate assessment of piston responsiveness under the maximum retard operating conditions. Accordingly, steps 336–334 are carried out to determine and compensate for the measured responsiveness of the piston 12. Specifically, a maximum retard rate is calculated at a step 336 as an average time rate of change in position between position signal samples. For example, if ten position signal samples are taken through ten iterations of the operations of FIG. 3, the change in phase between each of such readings may be averaged and the average divided by the time between such samples to arrive at an average time rate of change in phase, indicating the maximum retard rate of the piston 12. The maximum retard rate is next applied to reference a corresponding PID retard error band at a next step 338. A schedule of retard error bands as a function of maximum retard rates is generated in this embodiment through a conventional calibration procedure. For example, a preferred piston position trajectory from an initial position to a final position may be designed through the application of ordinary skill in the art. The position trajectory includes, near the final position, a controlled piston deceleration to minimize overshoot and oscillation with minimum compromise to overall response time. For each maximum retard rate along a range of maximum retard rates, the controlled deceleration must begin at varying times along the piston position trajectory. The time that such deceleration begins is established for each maximum retard rate, and is stored in the schedule as the PID error band with the corresponding maximum retard rate. The schedule is stored in a conventional non-volatile memory device of controller 23 of FIG. 1, such as a standard read only memory device. A current PID error band is then referenced from the stored schedule as the PID error band corresponding to the maximum retard rate calculated at step 336. The referenced PID error band is then stored as the current PID retard error band at a next step 344, for use in subsequent iterations of the operations of FIG. 2.

Following the step 344, and following the step 318, the sampling interrupt that invoked the operations of FIG. 3 is disabled at a step 320 and the counter used at the applicable one of steps 306 or 322 is cleared, as it is when power is initially applied to the controller 32 (FIG. 1) at the start of each operating cycle of the hardware of FIG. 1. After clearing the counter, or if the counter is determined to not yet equal the count limit at step 308 or step 334, the operations of FIG. 3 are concluded by returning, via a next step 350, to resume execution of any operations that were temporarily suspended following the occurrence of the sampling interrupt. The sampling interrupt will recur following a predetermined time period, such as about six milliseconds while it is enabled through the operations of FIG. 2, and each occurrence of the sampling interrupt will be serviced through the described operations of FIG. 3.

Referring to FIG. 4, a series of operations for carrying out on-line calibration of initial control points so that control values may be adjusted on-line are illustrated in a step by step manner. Such operations, like the operations of FIGS. 2 and 3, are implemented in the form of a sequence of instructions stored in controller non-volatile memory devices, and are carried out to service periodic time based controller interrupts. The interrupt that invokes the operations of FIG. 4 occurs about every twelve milliseconds while controller 32 is active in this embodiment. Upon occurrence of the interrupt, current controller operations of a lower priority are temporarily suspended, and the interrupt is serviced by carrying out the operations of FIG. 4, beginning at step 400 and proceeding to sample input signals at a next step 402, such as signals of a conventional type indicating engine operating parameters such as engine speed, and signals Pcr and Pca of FIG. 1, together indicating actual phase difference between the crankshaft 38 and camshaft 40 of FIG. 1.

Entry conditions are next checked at next step 404, as the conditions required to be present to allow for accurate on-line hydraulic control system calibration. For example, in this embodiment, entry conditions checked at the step 404 include comparing engine speed (rpm), which is proportional to the rate of rotation of the crankshaft 38 (FIG. 1) to a calibrated speed limit, such as about 500 r.p.m., and verifying that desired and actual piston position commands are currently set to zero. If such entry conditions as checked at the step 404, are determined to be met at a next step 406, then the on-line calibration procedures of steps 408–434 are carried out, by first outputting an initial commanded duty cycle to the inverter 34 and the switch 30 of FIG. 1. The initial commanded duty cycle is established through a conventional calibration procedure and is system specific, any will be on the order of about twenty five percent duty cycle. It is set to a sufficiently low value to ensure that it will not invoke motion of the piston 12 of FIG. 1, due to a generally known control deadband caused by frictional loading on piston 12 (FIG. 1). After outputting the initial duty cycle command, and following a predetermined delay indicated by step 410, such as about 150 milliseconds or any period of time necessary for the piston to be fully influenced by the command output at the step 408, signals Pcr and Pca are sampled and analyzed at a next step 412. If such signal samples indicate no substantial change in phase from a prior sampling and analysis of such signals, then the duty cycle command is increased by a fixed amount, such as about one percent duty cycle, at a next step 420, and the increased command is next output to the drive circuitry of FIG. 1, such as the inverter 34 and switches 28 and 30, at a step 422.

Following a delay as indicated by the described step 410, signals Pcr and Pca are again sampled and analyzed at step 412 and any movement of the piston 12 (FIG. 1), as indicted by change in phase of the signals is identified step 414. The steps 410–422 repeat until piston motion is detected at the step 414. When motion is detected, a control deadband, caused primarily by system friction load which is highly sensitive to system temperature, is overcome. To more responsively control the piston despite such control deadband, information characterizing the force needed to overcome the current deadband is stored via next steps 430–434, which are carried out following detection of motion at the step 414.

Specifically, the duty cycle command $DC_{CMD}$ is decreased slightly by a calibrated position offset $\delta$, which is less than one percent duty cycle, and is stored as learned control duty cycle (LCDC) at a step 430. A NEW LCDC flag indicating an update of the LCDC value is next set at a step 432, and the duty cycle command is then reset to zero at a next step 434, to end the on-line determination of the deadband. The information characterizing compensation for the current control deadband, termed LCDC, is applied as position offset to each piston position command, as described at step 238 of FIG. 2.

After clearing the duty cycle command at the step 434, or if it is determined that the entry conditions are not met at the step 406, the interrupt service operations of FIG. 4 are concluded by returning, via a next step 440, to resume execution of those operations that may have been suspended to allow for servicing of the current interrupt. The operations of FIG. 4 will be repeated periodically while the controller 32 of FIG. 1 is active, such as about every twelve milliseconds as described, to maintain an up-to-date characterization of the control deadband of the piston 12 of FIG. 1.

The preferred embodiment is not intended to limit or restrict the invention since many modifications may be made through the exercise of ordinary skill in the art without departing from the scope of the invention.

The embodiments of the invention in which a property or privilege is claimed are described as follows:

1. A hybrid control method for controlling a phaser mechanically linked to a camshaft of an internal combustion engine, the camshaft for actuating engine cylinder valves, to vary rotational phase between the camshaft and a crankshaft to vary valve timing, comprising the steps of:

determining a desired phase between the camshaft and the crankshaft;

estimating actual phase between the camshaft and the crankshaft;

generating phase error as a difference between the desired and actual phase;

providing a phase error band representing a range of phase error requiring a relatively high precision phase control strategy;

comparing the phase error to the phase error band;

controlling the phaser to drive the phase error toward zero in accordance with the relatively high precision phase control strategy when the phase error is within the phase error band; and controlling the phaser to drive the phase error toward zero in accordance with a relatively high response phase control strategy when the phase error is not within the phase error band.

2. The method of claim 1, wherein the phaser is controlled by applying a control command to an actuator coupled to the phaser, the method further comprising the steps of:

estimating phaser responsiveness to a change in the control command; and adjusting the phase error band as a function of the estimated phaser responsiveness.

3. The method of claim 2, further comprising the steps of:

setting the phase error band to an initial phase error band corresponding to an initial phaser responsiveness;

identifying a reduction in phaser responsiveness below the initial phaser responsiveness; and reducing the phaser error band below the initial phaser error band as a function of the identified reduction in phaser responsiveness;

identifying an increase in phaser responsiveness above the initial phaser responsiveness; and increasing the phaser error band above the initial phaser error band as a function of the identified increase in phaser responsiveness.

4. The method of claim 1, wherein the relatively high precision phase control strategy corresponds to a proportional-plus-integral phase control strategy.

5. The method of claim 1, wherein the relatively high response phase control strategy corresponds to a bang-bang phase control strategy.

6. The method of claim 1, wherein the phaser is controlled by applying a control command to an actuator coupled to the phaser, the control command including a command offset, the method further comprising the steps of:

providing an initial command offset; and periodically (a) estimating a control deadband representing a range of control command change for which there is substantially no phaser response, and (b) adjusting the initial command offset as a function of the estimated control deadband, to accurately compensate for a current estimated control deadband.

7. A method for generating a control command issued to a hydraulic actuator coupled to a camshaft phaser of an internal combustion engine, for varying phaser position to vary the rotational phase between the camshaft and a crankshaft in a variable engine cylinder valve timing application, comprising the steps of:

sampling at least one input signal indicating actual phase difference between the camshaft and crankshaft;

generating a desired phase difference in accordance with a desired engine cylinder valve timing;

calculating a phase error as a function of a difference between the desired phase difference and the actual phase difference;

identifying a phase error range requiring relatively high control response;

comparing the phase error to the identified phase error range;

generating the control command through application of a predetermined high response control function for driving the phase error toward zero when the phase error is within the phase error range;

generating the control command through application of a predetermined high precision control function for driving the phase error toward zero when the phase error is not within the phase error range; and issuing the control command to the hydraulic actuator to vary the phaser position in direction to drive the phase error toward zero.

8. The method of claim 7, further comprising the steps of:

estimating the maximum time rate of change in phaser position in response to a change in the control command as an indication of phaser responsiveness;

adjusting the phase error range in accordance with the estimated maximum time rate of change, to provide for an increased phase error range for a relatively low maximum time rate of change in phaser position, and to provide for a decreased phase error range for a relatively high maximum time rate of change in phaser position.

9. The method of claim 7, wherein the control command includes a command offset, the method further comprising the steps of:

estimating a range of relatively low magnitude control commands for which there is substantially no corresponding change in phaser position;

adjusting the command offset so the command offset is greater than at least a portion of the estimated range; and periodically repeating the estimating and adjusting steps.

* * * * *